United States Patent [19]

Limberger, deceased et al.

[11] 3,933,414

[45] Jan. 20, 1976

[54] ELECTROSTATIC COPYING MACHINE

[75] Inventors: Walter Limberger, deceased, late of Hamburg-Poppenbuttel, Germany; by Jurgen Limberger, heir; by Ursula Limberger, heir, both of Hamburg-Poppenbuttel, Germany

[73] Assignee: Lumoprint Zindler KG, Germany

[22] Filed: Oct. 30, 1974

[21] Appl. No.: 519,262

Related U.S. Application Data

[63] Continuation of Ser. No. 351,289, April 16, 1973.

[30] Foreign Application Priority Data

Apr. 19, 1972 Germany ..... 2218977

[52] U.S. Cl. ..... 355/3 R; 271/3; 355/11; 355/51

[51] Int. Cl.[2] ..... G03G 15/22

[58] Field of Search ..... 355/3 R, 8, 11, 14, 18, 355/27, 78, 97–111, 47–51; 271/3, 4, 10, 18

[56] References Cited

UNITED STATES PATENTS

| | | | |
|---|---|---|---|
| 3,044,386 | 7/1962 | Limberger | 355/50 X |
| 3,438,707 | 4/1969 | Hanson | 355/14 |
| 3,560,087 | 2/1971 | Washio et al. | 355/14 |
| 3,728,015 | 4/1973 | Opravil | 355/8 |
| 3,776,629 | 12/1973 | Ogawa | 355/8 |
| 3,806,112 | 4/1974 | Melby et al. | 271/10 |
| 3,827,687 | 8/1974 | Kono | 355/3 R X |
| 3,883,241 | 5/1975 | Zeuthen | 355/3 R |

*Primary Examiner*—Monroe H. Hayes
*Assistant Examiner*—Kenneth C. Hutchison
*Attorney, Agent, or Firm*—Toren, McGeady and Stanger

[57] ABSTRACT

An electrostatic copying machine which has a carriage for a documents original reciprocably movable at the upper side of the machine casing above a scanning aperture and which has an L-shaped light tunnel between the scanning aperture and the exposure station also has an L-shaped path for copy sheets through the machine. A copy sheet moves vertically downwardly in a straight line from a stack holder through electrostatic charging means and an exposure station and is turned to a horizontal path by a curved plate in a subsequent developing unit. The stack holder may be of the cassette type having a window through which the number of remaining copy sheets can be observed.

3 Claims, 3 Drawing Figures

ELECTROSTATIC COPYING MACHINE

This is a continuation of application Ser. No. 351,289 filed Apr. 16, 1973.

FIELD OF THE INVENTION

This invention relates to an electrostatic copying machine comprising a stack holder for sheet-form copy material, copy sheet withdrawal means associated with the stack holder and in the path of the copy sheet material, copy sheet charging means, an exposure station, a developing unit, drying means, a carriage for a document original which is reciprocably movable at the upper side of the machine casing above a scanning aperture, and an L-shaped light tunnel between the scanning aperture and the exposure station.

DESCRIPTION OF THE PRIOR ART

Copying machines of this type are known in which the copy sheets follow a U-shaped path through the machine. In certain of such machines a stack of copy sheets lies beneath the upper surface of the machine adjacent to the scanning aperture and adjacent to a vertical section of the light tunnel, and the copy sheet withdrawal means and the copy sheet charging means are arranged on a horizontal section of the copy sheet path parallel to the upper surface of the machine. The exposure station is in a vertical section of the copy sheet path and following the exposure station are special direction changing means to feed the copy sheet material into the other horizontal section of the path which includes the developing unit and the drying means. The two horizontal sections of the copy sheet path extend above and below the horizontal portion of the light tunnel.

It is also already known to arrange the copy sheet charging means in the vertical section of the copy sheet path when using a U-shaped copy sheet path of the type described above. This vertical arrangement of the charging means has advantages in respect of ventilation.

The location of the stack holder below the path of movement of the carriage for the original has the disadvantage that when the stack of copy sheets is used up the carriage must be raised in order to gain access to a hingeable section in the upper surface of the machine casing through which, when it has been opened, the supply of copy sheet material can be replenished. However, with this arrangement it is not possible for the machine operator to see what proportion of the stack of copy sheets still remains to be used.

Because of these difficulties it is also known to arrange the copy sheet material stack in the lower branch of a U-shaped copy sheet path just above the bottom of the machine casing and to use a box-type insertable unit as the stack holder. Such an arrangement has other disadvantages however, particularly the fact that the developing unit and drying means must then be positioned in the upper part of the machine. Again, it is still not possible readily to observe the supply of copy sheet material.

It is also known to provide a substantially rectilinear copy sheet path through a machine, wherein the copy sheet stack holder is arranged to extend towards the path at one side thereof and a delivery table is provided at the other side of the path. This machine has the disadvantage of a comparatively large structural length, because all the functional component parts must be arranged in sequence one after another along the length of the machine.

SUMMARY OF THE INVENTION

It is an object of the present invention to provide an electrostatic copying machine of the type first mentioned above which has an extremely short structural length, whose supply of copy sheet material can be replenished easily, wherein it is possible to observe the copy sheet supply to ascertain the quantity remaining, and wherein this short structural length is achieved additionally with a minimum of copy sheet guide means.

This is achieved in accordance with the present invention in that an L-shaped copy sheet path is provided, in which a copy sheet is guided from the stack holder through the copy sheet charging means and through the exposure station in a straight line and with the sole change of direction to the other section of the path being effected by means of a curved guide in the developing unit.

It is of particular advantage is the stack holder if positioned vertically. In this way, one achieves an extremely short machine casing, since its length is dependent substantially only on the length of sheet to be processed, with the proviso that the carriage above the upper surface of the casing must be movable outwardly sufficiently far to ensure that all portions of an original laid on the carriage pass over the scanning aperture. The term "scanning aperture" includes an arrangement in which the aperture itself is covered by a transparent plate or the like.

Primarily, the vertical arrangement of the stack holder in combination with the also vertical leg of the copy sheet path through the copy sheet charging means and the exposure station gives the advantage that a particularly favourable operation of the copy sheet charging means is attainable, and these components can be arranged directly below one another without direction-changing means. In this way, frictional effects on the copy sheet material can be avoided, whereas normally one has to allow for the fact that friction effects can lead to a certain degree of electrostatic charge on the copy sheets.

Preferably, the greater part of the stack holder projects upwardly from the machine and has its one end which is insertable into a receiving pocket open at one face. Spring means may be provided which press the copy sheet stack towards a copy sheet withdrawal roller arranged at the beginning of the copy sheet path in the machine. Thus, it is not only very easy to replace the stack holder, but, according to a preferred embodiment of the invention, a cassette-type stack holder is used which has in its end which projects into the functional part of the machine an aperture formed as an optically dim window through which the supply of copy sheet material therein can be observed.

According to a further preferred feature of the invention, at least the part of a cassette-type stack holder which is inserted into the receiving pocket has an inwardly movable, preferably hinged, wall section at its face adjacent to said spring means.

In order to achieve a machine casing of particularly low height it is preferable to provide an upward extension at the end of the upper surface of the casing remote from the scanning aperture, and to provide the receiving pocket for insertion of the stack holder in the upper surface of this extension. Thus, if this upward extension is positioned immediately above and as a continuation of an end wall of the machine there is the possibility of installing the machine in a space-saving way against a wall of a room so that the upward extension is against the room wall and out of the way, especially as this portion does not have to be attended to in the normal operation of the machine.

A preferred embodiment of the invention provides a machine in which a vertical leg of the copy sheet path includes the copy sheet withdrawal means, the copy sheet charging means and the exposure station, and a horizontal leg of the path includes the developing unit and drying means, with the latter leg arranged directly beneath a horizontal section of the light tunnel and with guide means for the carriage provided alongside the light tunnel.

BRIEF DESCRIPTION OF THE DRAWINGS

A preferred embodiment of electrostatic copying machine in accordance with the invention will now be described by way of example and with reference to the accompanying drawings, in which.

DESCRIPTION OF THE PREFERRED EMBODIMENT

Figure 2:
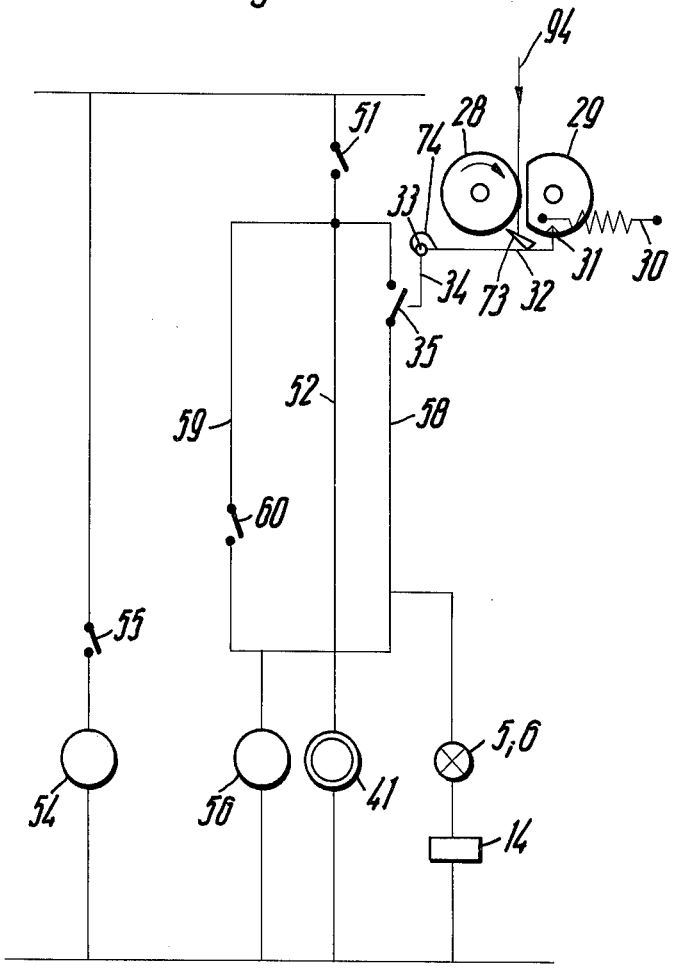
FIG. 2 is an electrical circuit diagram of the control circuit for the machine of FIG. 1; and, FIG. 3 is an end view on an enlarged scale of the machine shown in FIG. 1, as viewed from the right-hand side of FIG. 1 and with the facing end wall of the machine casing removed.

In the upper surface 1 of the machine casing 2, at one end and extending transversely to the longitudinal axis of the machine, there is provided a scanning aperture 3 beneath which scanning light sources 5 and 6 are arranged on each side of the vertical section 4 of a light tunnel. This vertical section 4 of the tunnel extends into a horizontal tunnel section 7 and optical reflector means 8 are provided at the junction of the two tunnel sections. An optical lens 65 is provided in the horizontal tunnel section 7. At the end of the tunnel section 7 remote from the reflector means 8 there is an exposure station 9 which comprises a transparent plate 10, plate-form counter-pressure means 11, and pairs of driven feed rollers 12 and 13 respectively arranged above and below the two plates 10, 11. The feed roller pairs 12, 13 guide the copy sheets through the exposure station. This exposure station is arranged in the vertical leg or section of the copy sheet path. Above the feed roller pair 12 there is provided on each side of the copy sheet path an electrostatic charging device 14, and above this there is provided a group of components indicated generally at 15 and comprising copy sheet withdrawal rollers and feed means for inserting the copy sheet material into the guide path. These components are mounted in an upwardly projecting extension 16 of the machine casing which rises above the upper surface 1 of the casing. The end wall 17 of this upward extension 16 remote from the upper surface 1 becomes at the top an upper wall 18 of the extension. In this upward extension 16 there is provided a recess 19 which is accessible from the top through an aperture 61. The recess 19 is closed at its sides and extends down to just below a copy sheet withdrawal roller 20 which is drivable and is mounted in the casing. This copy sheet withdrawal roller 20 projects into the recess 19 so that it presses against the topmost sheet of a stack 21 of copy sheets in a cassette-type stack holder 22 which is insertable vertically into the recess 19. The wall 23 of the stack holder 22 which is at the side facing the withdrawal roller 20 is cut away at the lower end. This cut-out is indicated at 24 and is provided so that the roller 20 can press directly against the copy sheets which are located within the cassette-type stack holder 22. The opposite wall 25 of the stack holder 22 is at this same end provided either with holes or with a wall section 26 which is pivotable about a hinge. After the insertion of a cassette-type stack holder, counter-pressure springs 27 act either through these holes or against the hinged wall section 26. The springs 27 may be arranged as a plurality of springs positioned next to one another across the width of the stack holder and press the copy sheets within the stack holder towards the withdrawal roller 20. The withdrawal and feed means 15 include in the illustrated embodiment a pair of rollers comprising a driven roller 28 and a roller 29 which has a flat area on its peripheral surface and which is also shown in FIG. 2. Such a roller pair is described for example in U.S. Pat. No. 3,552,849 and British patent specification No. 1,229,323.

Figure 1:
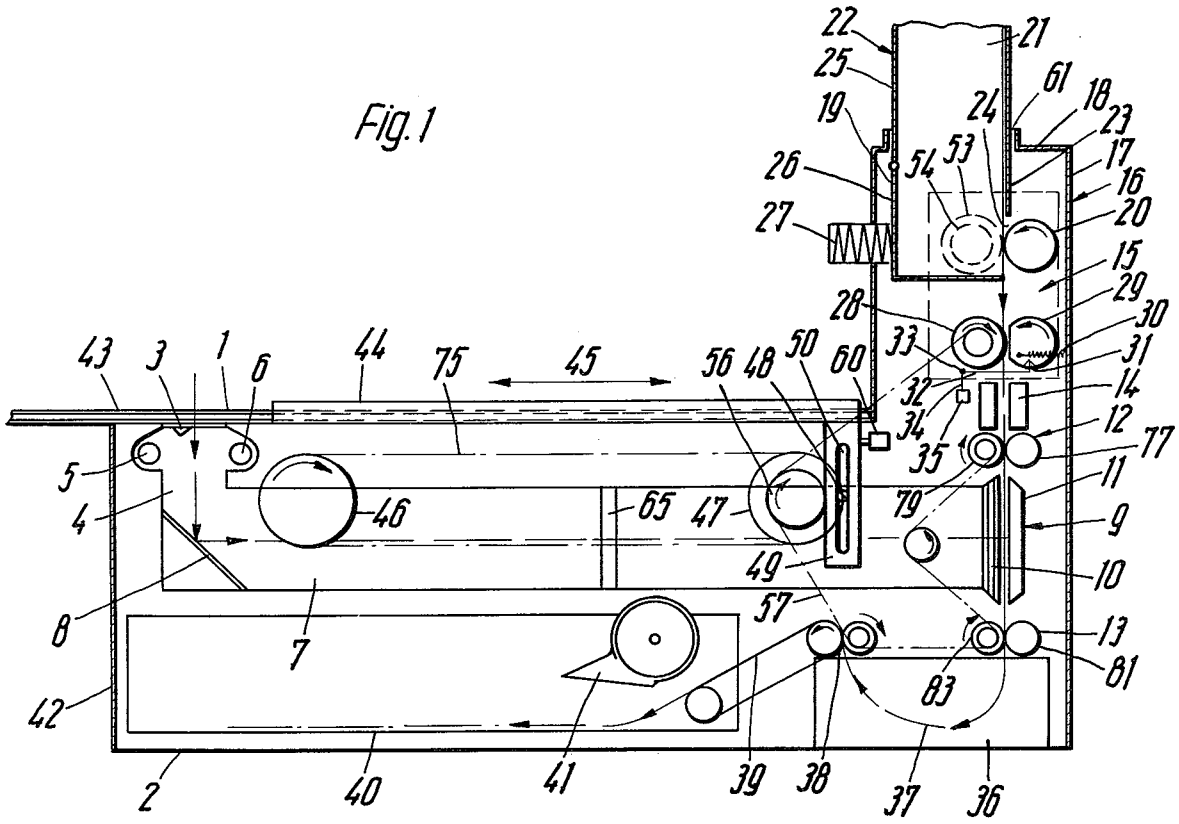
FIG. 1 is a schematic sectional side view of the machine wherein individual parts are shown in functional representation.
Figure 3:
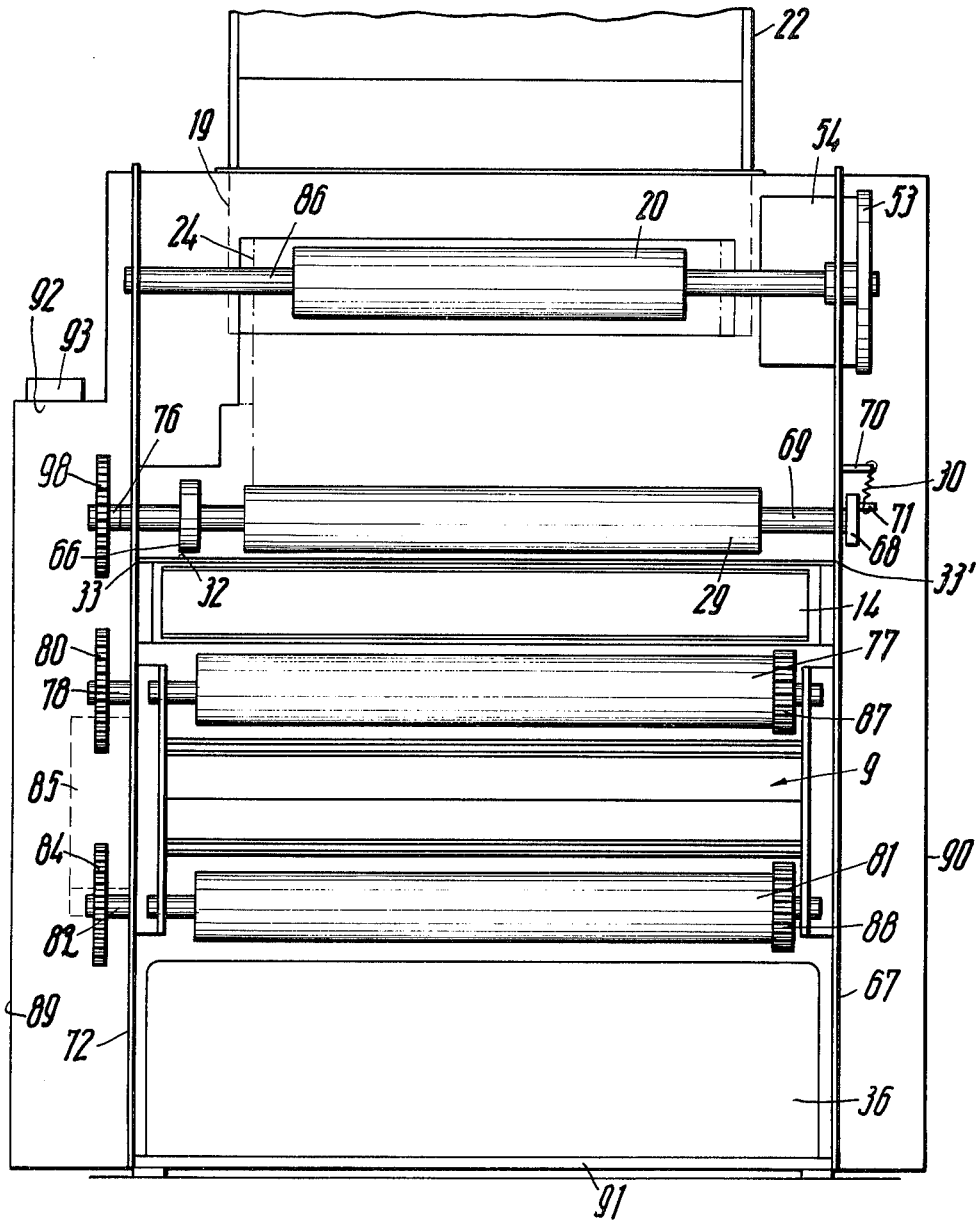

A spring 30 acts on the roller 29 which has the flat peripheral area. The spring 30, as is shown in FIG. 3, is arranged on a disc 66 which is provided on a shaft 69 of the roller 29, and in fact on the end of the shaft 69 which extends out through an inner support panel 67 of the casing so that the spring cannot wind itself around the shaft. For example, a crank pin 71 may be provided on the disc 68 for the spring 30. The other end of the spring 30 is secured to a pin 70 fixed in the support panel 67. A further disc 66 is also arranged on the shaft 69 outside the region of the roller 29 and lies alongside the nip of the rollers 28 and 29. The disc 66 has a peripheral locking recess 31 which is shown in FIGS. 1 and 2. A locking lever 32 engages in the locking recess 31 and is hinged pivotally at 33.

This hinge connection is shown in FIG. 3 at the inner support panel 72. The hinge is in the form of a rod, preferably extending as far as the other support panel 67, where it is shown as also hinged at 33'. There is thus provided a cross-piece from which in the region of the disc 66 the locking lever 32 extends perpendicular to the cross-piece. This means that it is possible, in the region of the hinge 33', which is shown as a rotary bearing, to mount a lever corresponding to the lever 32 likewise laterally outwardly of the roller 29, so that then beneath the nip of rollers 28 and 29 there extends a deflector blade indicated at 73 in FIG. 2 by means of which the lever 32 can be tilted out of the locking recess 31 when the leading edge of a copy sheet presses against the deflector blade 73. In this way the locking lever 32 is pivoted and the deflector blade 73 is removed from the track of a copy sheet corresponding to the arrow 94 in FIG. 2 so that then the spring 30 drives the roller 29 in the counter-clockwise sense and the arcuate portion of the circumference of the roller 29 comes into contact with the driven roller 28 and the copy sheet located in the nip is then entrained by the rollers.

It is possible to provide a weight-equalizing spring 74 for weight equaliation on the pivot mounting at 33 so that the copy sheet control is effected without a special loading on the copy sheets.

For control purposes, an arm 34 is provided on the lever 32 and actuates a switch 35 which will be referred to later.

Beneath the pair of feed rollers 13 there is the entry to a developing unit 36 which incorporates a curved guide 37. A more detailed description of this unit is not necessary since such developing units are well-known. At the output side of the developing unit there is provided a further pair of feed rollers 38 through which the copy sheets coming from the developing unit are fed, the sheets then passing over guide means 39 to a delivery area 40. The delivery area 40 may be accessible through a side wall of the casing if this is cut away at this position, or may be accessible from the side of the end wall 42 of the casing, in order to be able to remove the finished copy sheets.

Rails 43 are provided at both sides of the upper surface 1 of the casing for guidance of a carriage 44 back and forth in the direction of the double-headed arrow 45. The carriage 44 engages the rails 43 on downwardly open profiled channels formed in the carriage. A drive chain 75 which is guided around two sprocket wheels 46 and 47 may be provided for example as drive means for the carriage, the chain 75 carrying a pin 48 which moves in a vertical slot 50 in a slide block 49. The slide block 49 is set on one side of the carriage 44 and projects downwardly therefrom in front of one of the side support panels, and indeed downwardly to a region at which the chain 75 is located on the outside of the support panel. The slot 50 in the slide block 49 is sufficiently long that the pin 48 remains in the slot as it is moved along the upper and lower horizontal sections of the chain drive. This guidance system is shown only by way of example. Other known guidance systems may alternatively be provided. One of the sprocket wheels 46 is arranged to be an idler wheel.

This chain drive comprising the sprocket wheels 46 and 47 is preferably positioned alongside the horizontal section 7 of the light tunnel.

The method of operation of the machine will now be described with reference to FIG. 2. A main electrical circuit 52 which incorporates the drying fan 41 is controlled by a main switch 51. By means of the main switch 51 the machine is brought to an operational ready state.

Associated with the copy sheet withdrawal roller 20 is a control disc 53 with a drive which can be set for a predetermined number of revolutions. This drive is indicated in FIG. 1 as a motor coupling unit 54 and is energised by a separate switch 55 when a copy is to be made. Furthermore, a control motor 56 is provided in the machine which, by means of a chain 57, drives the roller 28, the pairs of feed rollers 12, 13 and 38, and also the sprocket wheel 47. The electrical circuit for this motor 56 is controlled by the main switch 51. It has two parallel branches 58 and 59, in one of which, i.e. branch 58, the above-mentioned switch 35 is arranged, and in the other of which, i.e. branch 59, is arranged a switch 60 which is actuated directly by the carriage 44 when it is positioned in its withdrawn end position as shown in FIG. 1. In this position of the carriage the switch 60 is open.

The scanning light sources 5 and 6 and the copy sheet charging means 14 are also included in the circuit having the two branches 58 and 59. If, after closure of the main switch 51 and the laying of an original on the carriage, one wishes to make a copy, then the switch 55 is closed manually. The copy sheet withdrawal roller 20 then feeds a copy sheet into the nip of the rollers 28 and 29. The leading edge of the copy sheet unlocks the roller 29 by actuating the lever 32, with the result that the switch 35 is closed and the motor 56 which drives the carriage 44 is energized. By this means any irregularity in the withdrawal of the copy sheets due to friction or other effects has no effect because the initiation of the carriage drive only takes place when the leading edge of the copy sheet has reached the predetermined position against the lever 32. By the unlocking of the roller 29 and as a result of the positive drive by means of the roller 28 and the rollers driven by the chain 57 there is thus an accurately defined feed arrangement, and the spacings and speeds are so chosen that the leading edge of the copy sheet enters the exposure station 9 at the same time that the leading edge of the original arrives over the scanning aperture 3.

It can be seen from FIG. 3 that a sprocket wheel 98 is arranged on the end of the shaft 76 of the roller 28 which extends through the support panel 72. In FIG. 3 the roller 77 of the roller pair 12 is visible, while behind this the shaft 78 of the co-operating roller 79 extends outwardly of the panel 72 and carries a sprocket wheel 80. Correspondingly, the roller 81 of the roller pair 13 is also visible in FIG. 3. The shaft 82 of the associated roller 83 extends through the panel 72 and carries a sprocket wheel 84. It will be apparent that the chain 57 is guided around the sprocket wheels 98, 80 and 84, and co-operates with the chain drive 75 which in FIG. 3 is indicated generally at 85.

For the rest, the various components shown in FIG. 3 are given the same reference numerals as they bear in FIGS. 1 and 2. It can be seen that the motor coupling unit 54 which co-operates with the control disc 53 is arranged on the support panel 67 behind the shaft 86 of the copy sheet withdrawal roller 20.

Gearwheels 87 and 88 are provided on the rollers 77 and 81 respectively and mesh with corresponding gearwheels of the associated rollers of the roller pairs 12 and 13. These associated rollers are the rollers 79 and 83.

A base plate 91 of the machine is provided between the side support panels 67 and 72 and on this base plate are provided casing side walls 89 and 90 outside the various control mechanisms. The switches 55 and 51 which are manually operable may be provided for example as part of a bank of switches 93 in a stepped recess 92 in the machine casing.

I claim:

1. An electrostatic copying machine in which an image is transferred from an original to a copy sheet, comprising an L-shaped machine casing including a first box-shaped part having longitudinally extending horizontally arranged upper and lower surfaces, a second box-shaped part extending vertically upwardly from one end of the upper surface of said first box-shaped part, said first box-shaped part including side surfaces extending vertically between said upper and lower surfaces and consisting of a first side surface, a second side surface located at the end of said first box-shaped part from which said second box-shaped part extends and disposed opposite to and spaced from said first side surface, a third side surface and a fourth side surface disposed opposite to and spaced from said third side surface, said first and second side surfaces disposed substantially perpendicularly to and extending between said third and fourth side surfaces, a horizontally arranged scanning aperture located in said upper surface adjacent to said first side surface and extending between said third and fourth side surfaces, a carriage movably mounted on said upper surface of said casing for reciprocal movement in the direction between said first and second side surfaces over said scanning aperture, an L-shaped light tunnel located within said first box-shaped part and having a vertically extending leg depending downwardly from said scanning aperture in said upper surface and a horizontally extending leg extending from the lower end of said vertical leg toward said second side surface and being in parallel relation therewith and spaced between and from said upper and lower surfaces, an optical reflector located at the junction of the vertical and horizontal legs of said light tunnel, the end of said horizontally extending leg of said light tunnel remote from said reflector aligned vertically below said second box-shaped part and forming an exposure station arranged to receive light rays from said reflector, said second box-shaped part located on the opposite side of said scanning aperture from said first side surface, said second box-shaped part forming an upward extension of the interior of said first box-shaped part from the upper surface of said first box-shaped part, said second box-shaped part having a downwardly extending recess in its upper horizontally arranged end, said second box-shaped part comprising two pair of vertically extending sides with one side of one said pair aligned with said second side surface and with one side of the other said pair aligned with said third side surface and the other side of the other said pair aligned with said fourth side surface, means defining an L-shaped path forming the complete path for the copy sheets through said machine casing, said L-shaped path comprising a vertical leg and a horizontal leg with said vertical leg extending substantially parallel to said vertical leg of said light tunnel and located at the opposite end of said machine casing adjacent said second side surface, said vertical leg of said L-shaped path extending downwardly from the lower end of said recess said second box-shaped part into said first box-shaped part to adjacent and above the lower surface of said first box-shaped part, said vertical leg of said L-shaped path intersecting the exposure station at the end of said horizontal leg of said L-shaped light tunnel, said horizontal leg of said L-shaped path connected to the lower end of said vertical leg and extending therefrom through said first box-shaped part toward said first side surface below and in generally parallel relation with said horizontal leg of said light tunnel, a developing unit positioned within said first box-shaped part and located in said horizontal leg of said L-shaped path at its junction with said vertical leg of said L-shaped path and said developing unit including a curved guide arranged to deflect copy sheets from a vertical to a horizontal orientation as they pass along said L-shaped path, a drying fan located in the horizontal leg of said L-shaped path and spaced from said developing unit toward said first side surface, a cassette-type stack holder arranged to hold copy sheets, said stack holder being removably insertable in the vertical direction into the recess in the upper end of said second box-shaped part with said stack holder extending vertically and arranged to position the copy sheets vertically for passage vertically downward directly into the upper end of the vertical leg of said L-shaped path, said cassette-type stack holder extending upwardly from the upper end of said second box-shaped part, means in the upper end of said vertical leg of said L-shaped path for removing individual copy sheets from said cassette-type stack holder and for passing them downwardly through the vertical leg of said L-shaped path, and an electrostatic charging device positioned in said vertical leg of said L-shaped path in advance of the position at which said vertical leg of said L-shaped path intersects the exposure station in said L-shaped light tunnel, said means for removing individual copy sheets and for passing them downwardly comprises a withdrawal roller located in said second box-shaped part at the lower end of said recess therein for removing individual copy sheets from said stack holder and three pairs of rollers spaced vertically and positioned in said L-shaped path for moving a copy sheet vertically downwardly within said casing with a first one of said pairs located between said withdrawal roller and said electrostatic charging device, a second one of said pairs located between said electrostatic charging device and said exposure station and a third one of said pairs located between said exposure station and said developing unit, said copying machine providing a compact and space saving device by the correlated L-shaped arrangements of said casing, said light tunnel and said path of the copy sheets.

2. An electrostatic copying machine, as set forth in claim 1, wherein spring means are mounted on the inside wall of the recess formed in said second box-shaped part and extend into contact with said cassette-type stack holder for biasing the copy sheets within said stack holder toward said withdrawal roller on the upper end of said vertical leg of said L-shaped path so that the copy sheets are positively displaced into contact with said withdrawal roller.

3. An electrostatic copying machine, as set forth in claim 2, wherein said cassette-type stack holder has a pivotally mounted wall section contacted by said spring means so that said wall section is displaced by said spring means against the copy sheets within said stack holder for positive displacement of the copy sheets toward said withdrawal roller in the upper end of said vertical leg of said L-shaped path.

* * * * *